US005077952A

United States Patent [19]

Moore

[11] Patent Number: 5,077,952

[45] Date of Patent: Jan. 7, 1992

[54] ROOF TILE CLIP

[75] Inventor: Peter J. Moore, Corona, Calif.

[73] Assignee: Monier Roof Tile Inc., Orange, Calif.

[21] Appl. No.: 421,277

[22] Filed: Oct. 12, 1989

[51] Int. Cl.[5] ..... E04B 9/00

[52] U.S. Cl. ..... 52/489; 52/547; 52/552

[58] Field of Search ..... 52/546, 545, 547, 520, 52/521, 478, 489, 543, 549, 550, 552, 112

[56] References Cited

U.S. PATENT DOCUMENTS

| | | | |
|---|---|---|---|
| 1,266,137 | 5/1918 | Melde | 52/550 |
| 1,975,304 | 10/1934 | Walter | 52/520 |
| 4,106,253 | 8/1978 | Aarons | 52/547 |
| 4,141,191 | 2/1979 | Aarons | 52/547 X |
| 4,182,090 | 1/1980 | Aarons | 52/547 |
| 4,314,433 | 2/1982 | Hulcombe | 52/521 |

FOREIGN PATENT DOCUMENTS

| | | | |
|---|---|---|---|
| 493738 | 6/1950 | Belgium | 52/550 |
| 1174891 | 12/1969 | United Kingdom | 52/550 |

*Primary Examiner*—Richard E. Chilcot, Jr.
*Assistant Examiner*—Lan Mai
*Attorney, Agent, or Firm*—Spensley Horn Jubas & Lubitz

[57] ABSTRACT

A roof tile clip for securing a roof tile to a roof structure has an elongated body portion secured at a lower end such as through a base portion extending from the body portion to the roof structure and a lip portion at an opposite upper end thereof extending over and engaging a side edge of the roof tile. The lip portion is inclined relative to the body portion by an amount approximately equal to the amount of inclination of the roof tile relative to the roof structure to provide a close, relatively conforming fit of the lip portion with the side edge of the roof tile. The clip is made from a single piece of aluminum. The lip portion is further configured to provide a conforming fit over a ridge at the roof tile's side edge, and includes a neck portion an an acute angle to the body portion so as to fit flat against an angled flat surface at the side of the roof tiles, an intermediate portion extending from the neck-portion and a terminal portion extending from the intermediate portion. The intermediate and terminal portions extend over and around and are configured to conform to the shape of the ridge and adjacent recess configuration of the side edge of the roof tile.

2 Claims, 3 Drawing Sheets

FIG. 1
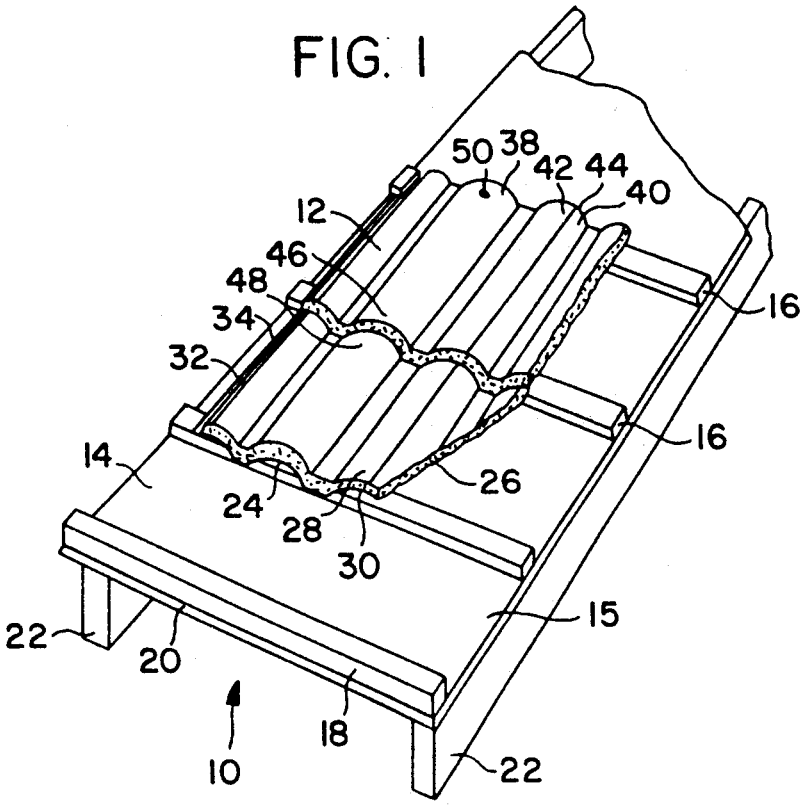
FIG. 2
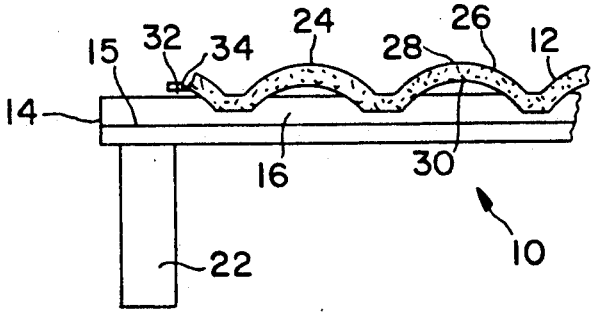
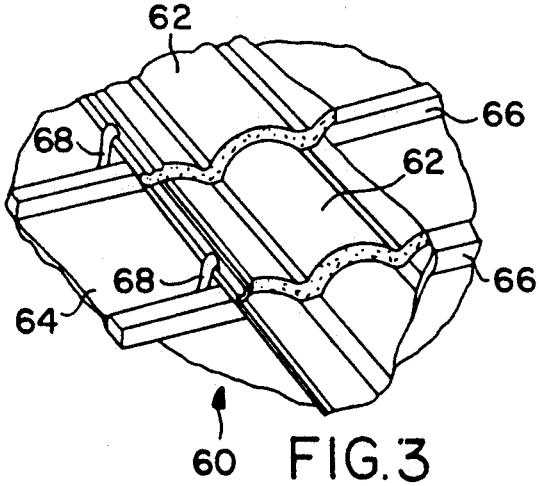
FIG. 3
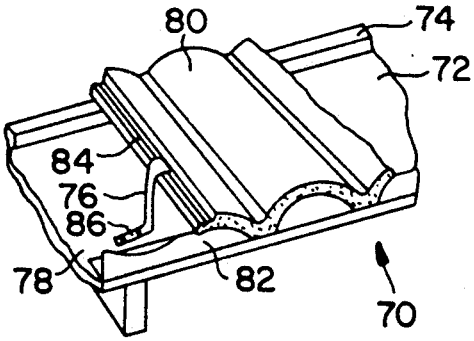
FIG. 4

FIG. 5
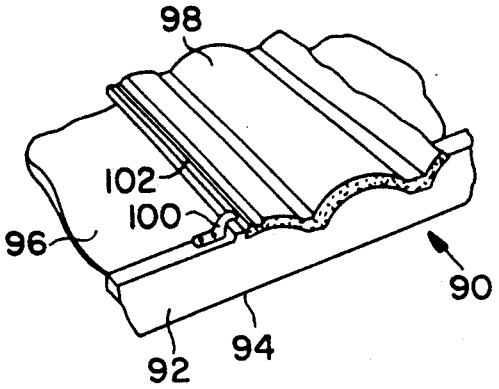
FIG. 6
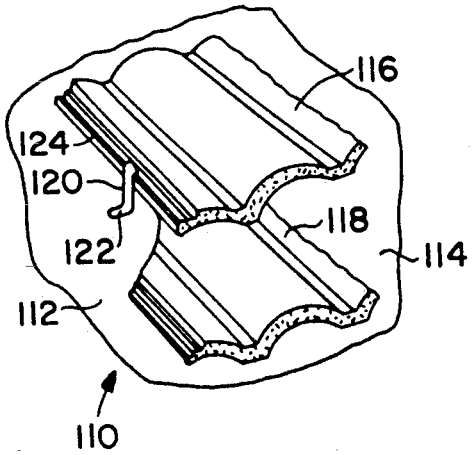
FIG. 7
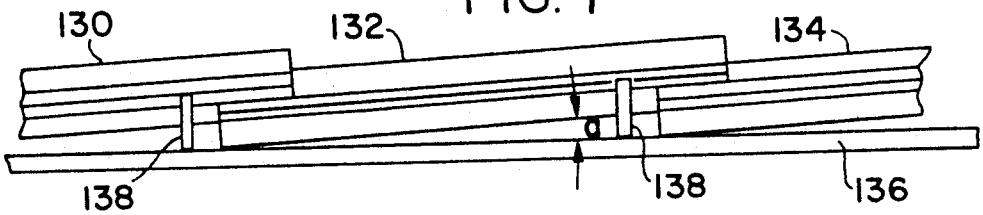
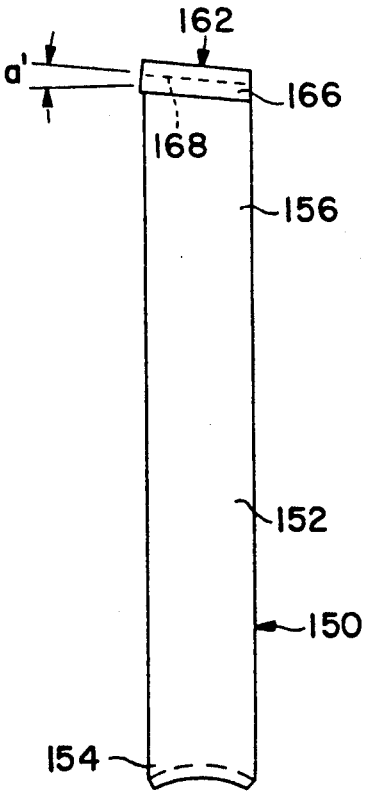
FIG. 8
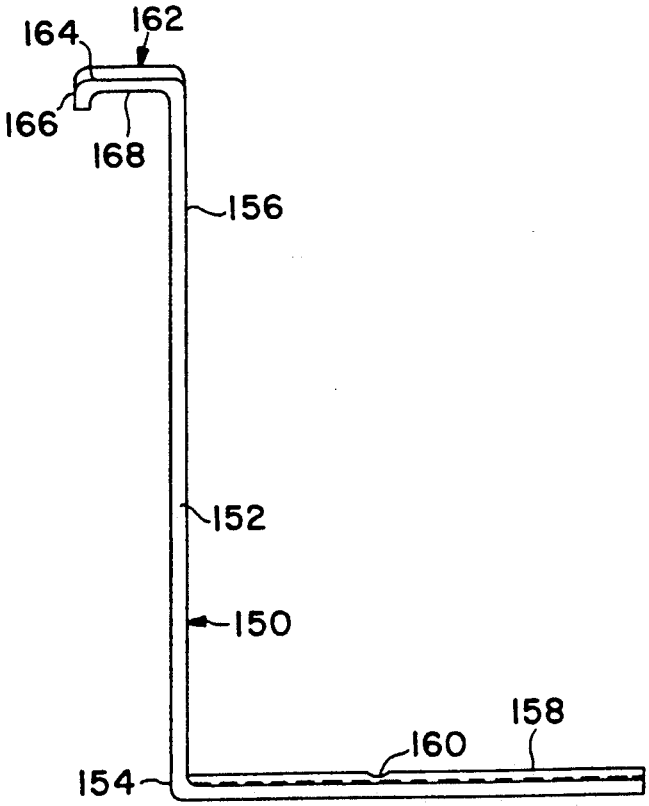
FIG. 9

FIG. 10
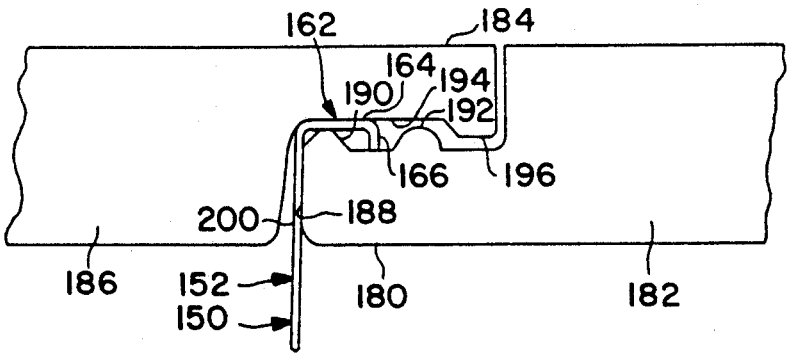
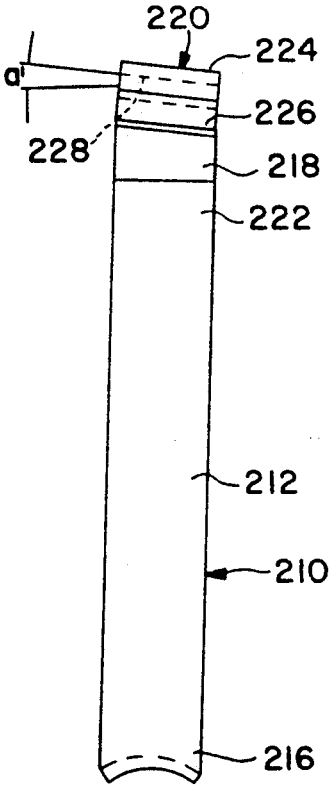
FIG. 11
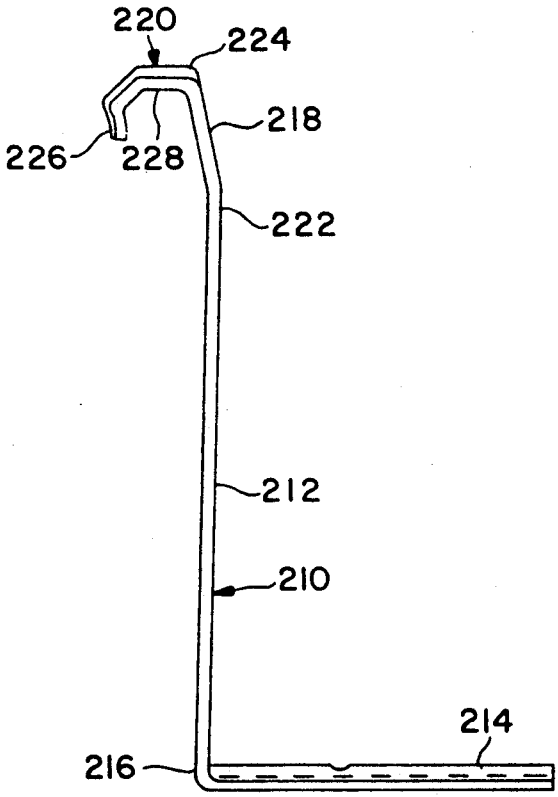
FIG. 12
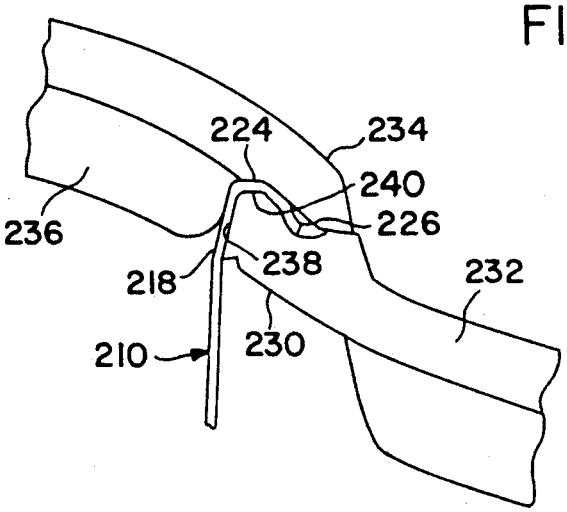
FIG. 13

ROOF TILE CLIP

BACKGROUND OF THE INVENTION

1. Field of the Invention

The present invention relates to roof tile clips used to hold a roof tile such as a concrete roof tile in place on a roof structure.

2. History of the Prior Art

Certain roof tiles such as concrete roof tiles are typically mounted on a roof structure by securing them directly to the solid deck of the roof structure, or to battens mounted in spaced-apart fashion on the solid deck. For example, such tiles may be provided with a nail hole adjacent an upper edge thereof so that a nail can be driven through the hole and into the underlying solid deck or batten to secure the tile in place. The tiles are installed in overlapping fashion. Upon installation of each tile by driving a nail through the nail hole thereof, the next tile thereabove is installed so that the lower edge thereof covers the upper edge including the nail and nail hole of the tile. At the same time, the opposite side edges of each tile overlap with the side edges of adjacent tiles to provide a continuous roofing configuration.

In installing roof tiles such as concrete tiles on a roof structure, roof tile clips are frequently used. Such clips which are secured to the roof structure extend over the side edges of the tiles adjacent the lower ends thereof to assist in securing the tiles in place and to prevent strong winds from lifting the lower edges of the tiles. Each tile is secured with a separate clip that is mounted either directly on the sold deck, on battens, or on a fascia board at the lower edge of the roof structure. Each clip extends upwardly from the roof structure and terminates in a curved upper end which extends over and engages the side edge of the associated tile adjacent the lower end of the tile. The clip is installed in place after the tile is secured to the roof structure. The next adjacent tile is then secured in place so that the side edge thereof covers the side edge of the tile including the clip.

The use of presently known roof tile clips in the installation of roof tiles is not without certain disadvantages. Principal among those disadvantages is the inability to achieve a reasonably close fit between the overlapping side edges of adjacent tiles. Such side edges are typically provided with one or more ridges designed to fit into and reside within mating slots so as to achieve an interlocking fit. Conventional roof tile clips typically protrude well above the tile edges that they engage so that a close fit of the overlapping edges of adjacent tiles is prevented.

A further problem with conventional roof tile clips lies in the materials of which such clips are made. Most such clips, for example, are made of galvanized steel. Materials such as galvanized steel have been found to deteriorate in time with exposure to the elements such that they eventually may break or bend or otherwise fail to continue to secure the tiles in place.

Accordingly, it would be advantageous to provide a roof tile clip of improved design. In particular, such roof tile clip should be capable of engaging the side edge of a tile in a manner permitting a close, securing fit of the side edge with the mating side edge of an adjacent tile. Such clip should be designed so as to accommodate a variety of different tile and tile edge configurations typically available, so as to provide a close conforming fit in each case. Further advantages would arise from a roof tile clip capable of withstanding the weathering effects of the elements over long periods of time, and for certain installations having a base portion configured to resist bending or twisting.

SUMMARY OF THE INVENTION

The foregoing and other objects are accomplished by improved roof tile clips in accordance with the invention. Such roof tile clips are configured to accommodate a variety of different tile and tile edge configurations and to provide a close, reasonably conforming fit in each case. In addition, such clips are preferably made of materials which will last a long time and, in the case of certain designs, are provided with a base portion designed to resist twisting and bending.

In accordance with a feature of the invention, each roof tile clip is provided with an inclined lip portion at the upper end of an elongated body portion thereof. Inasmuch as the overlapping installation of the tiles results in each tile being inclined at a relatively small acute angle relative to the solid deck of the roof structure, an improved and more conforming fit of the lip portion of the clip is provided by inclining the lip portion relative to an axis perpendicular to the axis of elongation of the body portion by an approximately equal acute angle. As a consequence, a flat tile engaging surface at the underside of the lip portion and which extends over a ridge in the side of the tile is inclined by an amount approximately equal to the extent of inclination of the tile relative to the solid deck. This allows the lip portion of the clip to fit relatively snugly over the side edge of the tile, permitting the overlapping side edge of the adjacent tile to fit tightly thereover.

In accordance with a further feature of the invention, a different clip configuration is provided for most roof tile designs in order to achieve a close conforming fit of the upper curved lip portion of the clip over the side edge of the roof tile. Typically, the side edge of a roof tile is provided with one or more ridges, and the edge may include a flat surface at an angled orientation. The curved lip portion of clips intended for use with such tiles is configured so as to conform to and fit tightly against the side edge of the tile. Where a flat angled surface is present at the tile edge, the lip portion of the clip is provided with a flat neck portion that extends from the body portion of the clip at an acute angle relative thereto so as to reside in conforming contact with the flat surface at the tile edge. The lip portion is further provided with an intermediate portion extending from the neck portion, and a terminal portion on the opposite side of the intermediate portion from the neck portion. The intermediate and terminal portions extend over and engage a ridge at the side edge of the tile. The terminal portion which is spaced-apart from the body portion of the clip is oriented so as to be generally parallel to the body portion.

In accordance with a further feature of the invention, the roof tile clips are made of a material and in a configuration so as to be capable of withstanding the elements over a long period of time. Aluminum has been found to be quite suitable as a material for the clips which are preferably fashioned in an integral configuration such as from a single piece of aluminum.

In accordance with a further feature of the invention, the clips as used for certain types of tile installations are provided with an improved base portion that extends from the lower end of the body portion. Such improved base portion which extends generally at a right angle from the lower end of the body portion is slightly arched so as to have a generally uniform curved cross-sectional shape along the length thereof. When the base portion of the clip is secured to the roof structure such as by driving a nail through a hole therein, the arched configuration of the base portion is effective in resisting twisting and bending.

BRIEF DESCRIPTION OF THE DRAWINGS

A better understanding of the invention may be had by reference to the following specification in conjunction with the accompanying drawings, in which:

FIG. 1 is a perspective view of a roof configuration including several concrete tiles and illustrating the manner in which such tiles are typically mounted on the roof structure;

FIG. 2 is a front view of the roof configuration of FIG. 1;

FIG. 3 is a perspective view of a roof configuration illustrating one manner in which roof tile clips according to the invention are used to help secure tiles to the roof structure;

FIG. 4 is a perspective view of a roof configuration illustrating another manner in which roof tile clips according to the invention are used to help secure tiles to the roof structure;

FIG. 5 is a perspective view of a roof configuration illustrating yet another manner in which roof tile clips according to the invention are used to help secure tiles to the roof structure;

FIG. 6 is a perspective view of a roof configuration illustrating yet another manner in which roof tile clips according to the invention are used to help secure tiles to the roof structure;

FIG. 7 is a side view of the roof configuration of FIG. 6 illustrating the manner in which the roof tiles are inclined relative to the roof structure as they are mounted thereon in overlapping fashion;

FIG. 8 is a side view of one embodiment of a roof tile clip according to the invention;

FIG. 9 is a front view of the roof tile clip of FIG. 8;

FIG. 10 is a front view of the side edge portions of two different roof tiles illustrating the manner in which the roof tile clip of FIGS. 8 and 9 is used in conjunction therewith;

FIG. 11 is a side view of a second embodiment of a roof tile clip in accordance with the invention;

FIG. 12 is a front view of the roof tile clip of FIG. 11; and

FIG. 13 is a front view of the side edge portions of two different roof tiles illustrating the manner in which the roof tile clip of FIGS. 11 and 12 is used in conjunction therewith.

DETAILED DESCRIPTION OF THE INVENTION

FIGS. 1 and 2 depict a roof configuration 10 utilizing a plurality of concrete roof tiles 12. The roof configuration 10 includes a flat roof structure 14 which may be comprised of a sheet of plywood with a thin sheet of water-barrier material such as tar paper disposed over the top thereof to form a deck 15. The roof structure 14 also includes a plurality of battens 16 mounted in spaced-apart, generally parallel fashion together with a fascia board 18 which extends across a lower edge 20 of the roof structure 14. The roof structure 14 is supported by eaves 22, two of which are shown in FIG. 1.

The roof tiles 12 are mounted on the flat roof structure 14 in overlapping fashion. The roof tiles 12 are mounted on the roof structure 14 in different rows or courses, with each course extending between a different pair of the battens 16. Thus, a tile 24 and a portion of an adjacent tile 26 within the same course are shown in FIG. 1 and in FIG. 2. The tile 24 has a side edge 28 thereof which mates with a side edge 30 of the adjacent tile 26 in overlapping fashion. The side edges of the various tiles within each course overlap in this fashion. The tile 24 has a side edge 32 opposite the side edge 28 which is not shown as being covered by the side edge of an adjacent tile in FIGS. 1 and 2 for clarity of illustration. It will be seen that the side edge 32 has a plurality of ridges 34 thereon, as do the other side edges of the roof tiles 12.

The roof configuration 10 shown in FIG. 1 also includes a pair of tiles 38 and 40 disposed above the tiles 24 and 26 and forming a part of the next row or course of tiles in the roof configuration 10. The tile 38 has a side edge 42 which overlaps a side edge 44 of the adjacent tile 40. In addition, the tile 38 has a lower edge 46 thereof which overlaps an upper edge 48 of the tile 24. The tile 40 has a lower edge which overlaps the upper edge of the tile 26 in similar fashion. As the tiles 12 are installed in the roof structure 14, the tiles within the next higher course overlap the tiles of the course immediately below.

In the examples of FIGS. 1 and 2 and thereafter, the roof tiles 12 are secured to the roof structure 14 by nails, although other conventional methods of securing the tiles can be used. Each of the roof tiles 12 is provided with a nail hole at the upper edge thereof. Thus, the tile 38 is shown to have a nail hole 50 at the upper edge thereof. A nail is driven through each nail hole such as the hole 50 in the tile 38 and into the underlying batten 16 to mount the tile in place. Mounting of the tiles may also be assisted by use of roof tile clips which are described hereafter. Such clips are secured to the roof structure adjacent lower portions of the side edges of the roof tiles to hold down the lower portions of the tiles. The roof tile clips are especially useful in preventing the wind from raising the lower portions of the tiles.

FIGS. 3-6 depict four different arrangements in which roof tile clips according to the invention can be used to assist in securing the roof tiles in place on the roof structure. In a particular roof configuration 60 shown in FIG. 3, a plurality of overlapping roof tiles 62 are shown mounted on a flat roof structure 64 which includes a plurality of battens 66. The mounting of each of the roof tiles 62 is assisted by a different roof tile clip 68 mounted on the side of one of the battens 66 so as to extend upwardly therefrom and engage one of the side edges of the tile. The roof tile clips 68 are mounted on the sides of the battens 66 by any appropriate fastening arrangement such as by driving a nail through a hole in a lower end of the clip 68 and then into the side of the batten 66.

Adjacent roof tiles have been omitted from FIG. 3 for clarity of illustration. In actuality the side edges of the roof tiles 62 and the adjacent portions of the roof tile clips 68 are covered by the side edges of adjacent roof tiles.

FIG. 4 shows a roof configuration 70 which is somewhat different from the roof configuration 60 of FIG. 3. The roof configuration 70 of FIG. 4 includes a flat roof structure 72 together with battens 74, as does the roof configuration 60 of FIG. 3. However, in the roof configuration 70 of FIG. 4, each of a plurality of roof tile clips 76 is mounted directly on a deck 78 of the flat roof structure 72 rather than being secured to the battens 74. FIG. 4 shows a roof tile 80 mounted so as to extend between the batten 74 and a birdstop 82 at a lower edge of the flat roof structure 72. The roof tile 80 has a side edge 84 thereof engaged by the roof tile clip 76. The roof tile clip 76 has a base portion 86 at a lower end thereof which is secured to the deck 78 of the flat roof structure 72 such as by use of nails.

FIG. 5 depicts a roof configuration 90 in which a fascia board 92 is mounted at a lower edge 94 of a flat roof structure 96 of the roof configuration 90. A roof tile 98 is disposed so that a lower edge thereof resides on the fascia board 92. The lower edge of the roof tile 98 is held in place on the fascia board 92 by a roof tile clip 100 mounted on the top edge of the fascia board 92. The roof tile clip 100 engages a side edge 102 of the roof tile 98. Although not shown in FIG. 5 the lowest row or course of roof tiles which includes the roof tile 98 is comprised of overlapping tiles, each of which has a lower edge thereof secured to the top of the fascia board 92 by a roof tile clip like the clip 100.

FIG. 6 depicts a roof configuration 110 having a flat roof structure 112 which is comprised of a deck 114 without battens. The roof tiles are mounted directly on the deck 114 in overlapping fashion, with two of the roof tiles 116 and 118 being shown in FIG. 6. The lower portion of the roof tile 116 is secured to the flat roof structure 112 by a roof tile clip 120. The roof tile clip 120 which has a base portion 122 at a lower end thereof secured to the deck 114 such as by nailing extends upwardly from the deck 114 and engages a side edge 124 of the tile 116. The roof tile 118 and others not shown in FIG. 6 are secured to the deck 114 using roof tile clips like the clip 120.

The different roof configurations of FIGS. 3–6 illustrate the fact that the roof tile clips can be made in different lengths and configurations, depending upon the manner in which they are mounted on the roof structure. In each case, however, the roof tile clip engages a side edge of an associated roof tile in similar fashion so as to assist in mounting the roof tile on the roof structure together with the nail driven through the nail hole at the top edge of the roof tile. The roof tile clips shown and described hereafter are of elongated configuration and terminate in a base portion at a lower end thereof as in the examples of FIGS. 4 and 6. Nevertheless, the principles of the invention are applicable to other roof tile clip configurations such as those shown in FIGS. 3 and 5.

FIG. 7 shows three different roof tiles 130, 132 and 134 mounted on a deck 136 in overlapping fashion, much as the roof tiles 116 and 118 are mounted on the deck 114 in the roof configuration 110 of FIG. 6. A pair of roof tile clips 138 are shown securing the lower ends of the roof tiles 130 and 132 to the deck 136.

As shown in FIG. 7 the overlapping configuration of the roof tiles 130, 132 and 134 inclines the tiles relative to the deck 136 such that each of the tiles 130, 132 and 134 forms a small acute angle of like value with the deck 136. As illustrated in FIG. 7 the roof tile 132 forms a small acute angle "a" with the deck 136. Such inclination of the roof tiles relative to the underlying roof structure is also present in the roof configurations of FIGS. 3, 4 and 5.

FIGS. 8 and 9 depict one embodiment of a roof tile clip 150 according to the invention. The roof tile clip 150 has an elongated body portion 152 of thin planar configuration extending between a lower first end 154 thereof and an upper second end 156 thereof. The lower first end 154 of the body portion 152 is secured to the underlying deck of a flat roof structure by a base portion 158 extending outwardly from the body portion 152 on one side of the plane of the body portion 152 and being generally perpendicular to the body portion 152. The base portion 158 is of arched configuration along the length thereof so as to have a uniform curved cross-sectional shape along the length thereof. An aperture 160 extending through a central part of the base portion 158 receives a nail so that the base portion 158 can be nailed to an underlying deck to mount the roof tile clip 150 thereon. The arched cross-sectional configuration of the base portion 158 resists twisting and bending of the roof tile clip 150. If the base portion 158 were flat, the roof tile clip 150 would be much more prone to bending and twisting.

The roof tile clip 150 includes a curved lip portion 162 at the upper second end 156 of the body portion 152. The curved lip portion 162 which is configured to engage the side edge of a roof tile extends laterally from the body portion 152 on the opposite side of the plane of the body portion 152 from the base portion 158. The lip portion 162 includes an intermediate portion 164 and a terminal portion 166 on the opposite side of the intermediate portion 164 from the body portion 152. The intermediate portion 164 has a relatively flat tile engaging surface 168 at the underside thereof. The terminal portion 166 is spaced-apart from and generally parallel to the plane of the body portion 152.

As best shown in FIG. 8 the lip portion 162 with its tile engaging surface 168 at the underside of the intermediate portion 164 thereof is inclined relative to the body portion 152. More specifically, the lip portion 162 is inclined relative to an axis perpendicular to the axis of elongation of the body portion 152 by an amount essentially equal to the amount of inclination of the overlapping roof tiles relative to the roof structure. Thus, the lip portion 162 forms an acute angle "a," with an axis perpendicular to the axis of elongation of the body portion 152. The acute angle "a," is essentially equal to the acute angle "a" which the roof tile 132 forms with the deck 136 in the illustration of FIG. 7.

The manner in which the roof tile clip 150 engages the side edges of roof tiles in close and relatively conforming fashion is shown in FIG. 10. FIG. 10 shows a side edge 180 of a roof tile 182 and an overlapping side edge 184 of an adjacent roof tile 186. The side edge 180 of the roof tile 182 has a flat surface 188 at the outer edge thereof, a first ridge 190 adjacent the flat surface 188 and a second ridge 192 spaced- apart from the first ridge 190 on the other side thereof from the flat surface 188. The overlapping side edge 184 of the adjacent roof tile 186 is provided with a groove 194 therein inside of a ridge 196 for receiving the first and second ridges 190 and 192. The groove 194 which forms part of a slot at the underside of the side edge 184 in the region of the roof tile clip 150 is recessed far enough into the underside of the side edge 184 to permit the lip portion 162 of the clip 150 to reside between the side edges 180 and 184 while permitting a close interlocking fit between the side edges 180 and 184.

The side edges 180 and 184 of the roof tiles 182 and 186 are configured so as to interlock in mating fashion.

In accordance with the invention, the lip portion 162 of the roof tile clip 150 is designed to provide minimum interference with the mating fit of the side edges 180 and 84 while at the same time effectively engaging and securing the roof tile 182. This is accomplished in part by virtue of the inclined orientation of the lip portion 162 relative to the body portion 152 of the tile clip 150. Inasmuch as the body portion 152 extends upwardly from the roof structure on which it is mounted so as to be generally normal to the roof structure, whereas the roof tiles are inclined at the acute angle "a" relative to the roof structure, the inclination of the lip portion 162 relative to the body portion 152 at the equal acute angle "a'" enables the lip portion 162 to engage and lie flat on the side edge 180 of the roof tile 182 along the entire length of the lip portion 162. If the lip portion 162 were not so inclined, one end thereof would be raised above the side edge 180 so as to interfere with the close mating fit of the side edge 184 of the roof tile 186 over the side edge 180 of the roof tile 182.

In accordance with a further feature of the invention, the close mating fit of the side edge 180 of the roof tile 182 with the side edge 184 of the roof tile 186 in spite of the presence of the roof tile clip 150 is permitted by a lip portion 162 which is shaped to generally conform with the mating side edges 180 and 184. To do this, a different roof tile clip is provided for most different tile side edge configurations. The description hereafter with respect to FIGS. 11–13 provides an example of a roof tile clip having a different lip portion from the lip portion 162 of the clip 150 in order to conform with a different tile configuration.

In the example of FIGS. 8–10 the lip portion 162 has a neck portion 200 at the upper end of the body portion 152 which is generally continuous and coplanar with the body portion 152. The neck portion 200 which is of thin, planar configuration resides in conforming fashion against the flat surface 188 of the side edge 180. The intermediate portion 164 of the lip portion 162 is configured so as to extend over the first ridge 190, with the terminal portion 166 extending down into the recess between the ridges 190 and 192.

FIGS. 11 and 12 show a roof tile clip 210. The roof tile clip 210 is similar to the roof tile clip 150 of FIGS. 8 and 9 to the extent that it includes an elongated body portion 212 of thin, planar configuration having a base portion 214 of arched cross-sectional shape extending outwardly from a lower end 216 of the body portion 212. The body portion 212 terminates in a neck portion 218 of a lip portion 220 at an upper end 222 thereof. The neck portion 218 is of thin, planar configuration and forms a relatively small acute angle with the plane of the body portion 212. The neck portion 218 terminates in an intermediate portion 224 of the lip portion 220 opposite the body portion 212. On the opposite side of the intermediate portion 220 from the neck portion 218 is a terminal portion 226. The intermediate portion 224 has a relatively flat tile engaging surface 228 at the underside thereof The lip portion 220 is inclined relative to the body portion 212 of the roof tile clip 210 by the angle "a'", as shown in FIG. 11. In addition, the lip portion 220 is configured so as to mate closely with the side edge of the tile with which it is to be used.

FIG. 13 depicts the upper portion of the roof tile clip 210 together with a side edge 230 of a roof tile 232 and the mating side edge 234 of an adjacent roof tile 236. The side edge 230 has a flat surface 238 which is inclined relative to the vertical and which receives the neck portion 218 of the roof tile clip 210. The flat surface 238 terminates at an upper end thereof in a ridge 240. The intermediate portion 224 and the terminal portion 226 are configured to extend over the top of the ridge 240 and down the side thereof opposite the flat surface 238 in conforming fashion. Consequently, the roof tile clip 210 poses virtually no interference between the mating side edges 230 and 234 of the roof tiles 232 and 236.

While the roof tile clip 150 of FIGS. 8 and 9 and the roof tile clip 210 of FIGS. 11 and 12 can be fashioned in any appropriate way such as by forming the base, body and lip portions separately and then joining them together such as by welding, such clips are readily made by shaping a single piece of metal. Aluminum is suitable and is preferred because of its workability as well as its endurance. When installed as part of a roof construction over a long period of time, aluminum undergoes little or no deterioration and therefore resists bending and breaking.

While the invention has been particularly shown and described with reference to preferred embodiments thereof, it will be understood by those skilled in the art that various changes in form and details may be made therein without departing from the spirit and scope of the invention.

What is claimed is:

1. A roof tile clip comprising a body portion extending along an axis of elongation between opposite first and second ends, an elongated base portion extending from and generally perpendicular to the first end for mounting the body portion on a roof structure, and a curved lip portion extending laterally from the second end of the body portion and having a relatively flat tile engaging surface at an underside thereof, the tile engaging surface being inclined at a relatively small angle relative to an axis perpendicular to the axis of elongation of the body portion and the elongated base portion having a generally uniform curved cross-sectional shape along the length thereof.

2. A roof tile clip comprising an elongated body portion having a lip portion at an end thereof, the body portion being of thin planar configuration and the lip portion including a neck portion thereof of thin planar configuration extending from and forming an acute angle with the thin planar configuration of the body portion, an intermediate portion extending from the neck portion opposite the body portion, and a terminal portion extending from the intermediate portion opposite the neck portion and having a first portion relatively flat configuration forming an acute angle with the intermediate portion and a second portion which is angled relative to the first portion and which curves outwardly and away from the neck portion which is disposed opposite thereto, the intermediate portion and the terminal portion being configured to extend over and around the ridge in the edge of the roof tile, the clip including a base portion extending from an end of the body portion opposite the lip portion, the base portion being perpendicular to the planar configuration of the body portion and being of arched cross-sectional configuration along the length thereof.

* * * * *